US009538302B2

(12) United States Patent
Turgul

(10) Patent No.: US 9,538,302 B2
(45) Date of Patent: Jan. 3, 2017

(54) DETECTING HEADPHONE EARPIECE LOCATION AND ORIENTATION BASED ON DIFFERENTIAL USER EAR TEMPERATURE

(71) Applicant: Genya G Turgul, Milwaukee, WI (US)

(72) Inventor: Genya G Turgul, Milwaukee, WI (US)

( * ) Notice: Subject to any disclaimer, the term of this patent is extended or adjusted under 35 U.S.C. 154(b) by 55 days.

(21) Appl. No.: 14/603,349

(22) Filed: Jan. 22, 2015

(65) Prior Publication Data

US 2015/0215719 A1 Jul. 30, 2015

Related U.S. Application Data

(60) Provisional application No. 61/930,956, filed on Jan. 24, 2014.

(51) Int. Cl.
*H04R 29/00* (2006.01)
*H04R 1/10* (2006.01)

(52) U.S. Cl.
CPC ..... *H04R 29/00* (2013.01); *H04R 1/1091* (2013.01); *H04R 2410/03* (2013.01)

(58) Field of Classification Search
CPC ..... H04R 29/00; H04R 1/10; H04R 1/1016; H04R 1/1091; H04R 2410/03; H04R 5/033; H04R 2420/05; H04R 1/1041; H04R 2201/107; H04R 25/00; H04R 25/30; H04R 25/305; H04R 25/552; H04R 25/60; H04R 25/604
USPC ..... 381/74
See application file for complete search history.

(56) References Cited

U.S. PATENT DOCUMENTS 8,515,110 B2 * 8/2013 Neumeyer ..... H04R 25/50 381/312
2011/0144779 A1 * 6/2011 Janse ..... G11B 20/10009 700/94
2014/0129010 A1 * 5/2014 Garg ..... H04R 1/1016 700/94
2014/0321682 A1 * 10/2014 Kofod-Hansen .... H04R 25/305 381/315
2015/0326969 A1 * 11/2015 Tu ..... H04R 3/00 381/74

* cited by examiner

*Primary Examiner* — Vivian Chin
*Assistant Examiner* — Jason R Kurr

(57) ABSTRACT

Techniques for determining whether a speaker element, or "earpiece," of an earphone or headphone set is located within, or proximate to, a right ear, a left ear, or neither ear of a user of the set may include receiving a first temperature value from a first temperature sensor, receiving a second temperature value from a second temperature sensor, and determining whether the speaker element is located within, or proximate to, the right ear, left ear, or neither ear, based on (e.g., a difference between) the first and second temperature values. The techniques may further include receiving a third temperature value from a third temperature sensor, such as an user ambient temperature sensor, or a user body temperature sensor, and further determining whether the speaker element is located within, or proximate to, the right ear, left ear, or neither ear, based on the third temperature value.

19 Claims, 9 Drawing Sheets

DETECTING HEADPHONE EARPIECE LOCATION AND ORIENTATION BASED ON DIFFERENTIAL USER EAR TEMPERATURE

CROSS-REFERENCE TO RELATED APPLICATION

This application claims the benefit of U.S. Provisional Application number 61/930,956 filed Jan. 24, 2014, which is hereby incorporated by reference in its entirety.

TECHNICAL FIELD

The present disclosure generally relates to devices capable of providing an audio output to a user and, more particularly, to electronic audio devices configured to provide an audio output to a user via one or more so-called "earphone" or "headphone" sets, otherwise referred to simply as "earphones" or "headphones."

BACKGROUND

A number of industrial and consumer electronic devices, such as desktop, laptop, and hand-held (e.g., so-called "tablet") computers, portable media players (e.g., compact disc (CD) players, MPEG-2 Audio Layer III (MP3) and similar digital audio players, and digital video players), as well as numerous other devices (e.g., so-called "smartphones"), are capable of providing users with a variety of media content. For example, many stationary and portable (e.g., so-called "mobile") electronic devices are configured to provide an audio output to a user in the form of music, speech, or any combination thereof. For this purpose, many such devices include one or more integrated electroacoustic transducers, including loudspeakers, piezoelectric speakers, and other speaker types. These devices are configured to provide an audio output to a user in the form of sound waves that originate at one or more such transducers and travel toward the user's ears through air and/or other media. In contrast, many other electronic devices are configured to provide an audio output to a user via one or more miniature electroacoustic transducers, which may be referred to as "speaker elements," that are integrated into so-called "earphone" or "headphone" sets designed to be placed within, or proximate to, one or more of the user's ears. In these examples, sound waves produced by the speaker elements are transmitted directly into one or more of the user's ears, allowing enhanced sound directionality and noise isolation. In some examples, the audio output provided to the user may contain stereophonic information, such as, e.g., differential content, or so-called "phasing," between right and left components, or so-called "channels," of a stereo audio signal that are intended for the user's right and left ears, respectively. In such instances, for the user to perceive the audio output correctly, the user may receive each of the right and left components of the stereo audio signal via the speaker elements at the corresponding designated ear.

SUMMARY

In general, the techniques of this disclosure are directed to devices capable of providing an audio output to a user. Specifically, the techniques described herein relate to electronic audio devices configured to provide an audio output to a user via one or more so-called "earphone" or "headphone" sets, otherwise referred to simply as "earphones" or "headphones." In particular, the present disclosure describes techniques that may enable an electronic audio device used in conjunction with a headphone set to automatically detect one or more of a location and a relative orientation of one or more speaker elements, or so-called "earpieces," of the headphone set with respect to one or more of a user's ears based on differential user ear temperature. The disclosed techniques may further enable the electronic audio device to, in response to detecting the one or more of the location and relative orientation of the speaker elements, modify an audio output provided to the user by the electronic audio device via the speaker elements in one or more ways.

In one example, a method of determining whether a speaker element of a headphone set is located proximate to a right ear, a left ear, or neither ear of a user of the headphone set includes receiving a first temperature value from a first temperature sensor, receiving a second temperature value from a second temperature sensor, and determining whether the speaker element is located proximate to the right ear, left ear, or neither ear, based on the first and second temperature values. In this example, the first and second temperature sensors are different temperature sensors.

In another example, an apparatus for determining whether a speaker element of a headphone set is located proximate to a right ear, a left ear, or neither ear of a user of the headphone set includes one or more computing devices configured to receive a first temperature value from a first temperature sensor, receive a second temperature value from a second temperature sensor, and determine whether the speaker element is located proximate to the right ear, left ear, or neither ear, based on the first and second temperature values. In this example, the first and second temperature sensors are different temperature sensors.

In another example, a non-transitory computer-readable storage medium includes instructions that cause one or more computing devices to determine whether a speaker element of a headphone set is located proximate to a right ear, a left ear, or neither ear of a user of the headphone set. The instructions cause the one or more computing devices to receive a first temperature value from a first temperature sensor, receive a second temperature value from a second temperature sensor, and determine whether the speaker element is located proximate to the right ear, left ear, or neither ear, based on the first and second temperature values. In this example, the first and second temperature sensors are different temperature sensors.

The details of one or more examples consistent with the techniques of the present disclosure are set forth in the description provided below and in the accompanying drawings. Other features, objects, and advantages of the techniques described herein will be apparent from the description and drawings, and from the claims also set forth below.

DETAILED DESCRIPTION

Figure 1:
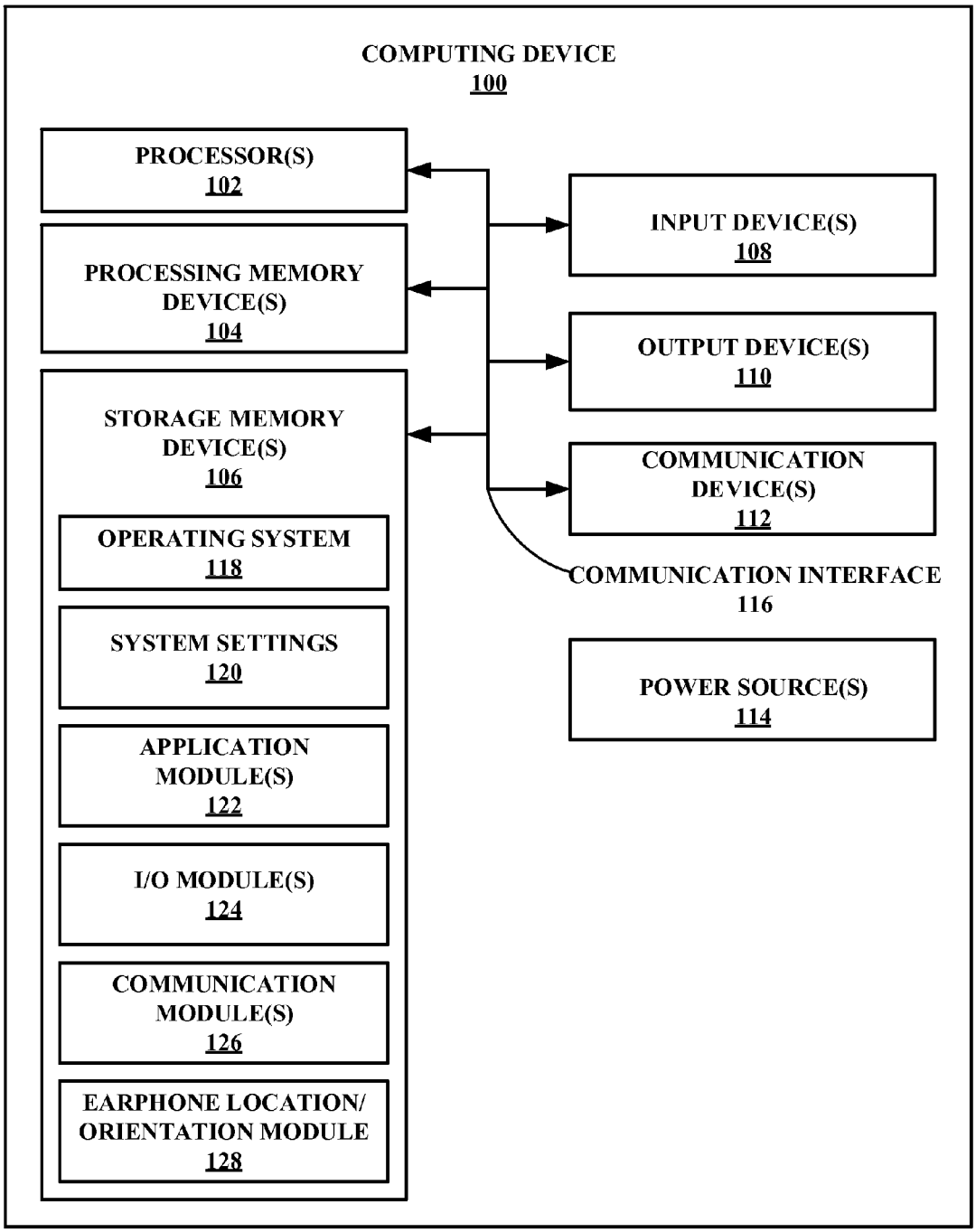
FIG. 1 is a functional block diagram that illustrates an example computing device that may be used to determine whether a speaker element of a headphone set is located proximate to a right ear, a left ear, or neither ear of a user of the headphone set, consistent with the techniques of this disclosure.

In general, the techniques of this disclosure are directed to devices capable of providing an audio output to a user. Specifically, the techniques described herein relate to electronic audio devices configured to provide an audio output to a user via one or more so-called "earphone" or "headphone" sets, otherwise referred to simply as "earphones" or "headphones." In particular, the present disclosure describes techniques that may enable an electronic audio device used in conjunction with a headphone set to automatically detect a location and/or a relative orientation of one or more speaker elements, or so-called "earpieces," of the headphone set with respect to one or more of a user's ears based on differential user ear temperature. The disclosed techniques may further enable the electronic audio device to, in response to detecting the location and/or relative orientation of the speaker elements in the manner described above, modify an audio output provided to the user by the electronic audio device via the speaker elements in one or more of the following ways.

As one example, the electronic audio device may selectively interchange, or "switch," multiple components, or so-called "channels," of a multi-channel audio signal (e.g., a stereo audio signal) associated with the audio output for transmission to one or more of the speaker elements. For example, in the event the orientation of the speaker elements of the headphone set with respect to the user's ears is such that right and left channels of the audio output and the user's right and left ears are mismatched (e.g., reversed), the electronic audio device may interchange the right and left channels prior to their transmission to the speaker elements so that the channels and the user's ears are correctly matched. As another example, the electronic audio device may merge, or "mix," multiple audio channels of the multi-channel audio signal for transmission to one or more of the speaker elements. For example, in instances where the user is using only one of the speaker elements to listen to the audio output (e.g., when previewing the audio output), the electronic audio device may merge the right and left channels of the audio output and transmit both channels to the particular speaker element being used. Furthermore, in cases where multiple users are each using one of the speaker elements (e.g., at the same ear of the respective user) to listen to the audio output, the electronic audio device may merge the right and left channels of the audio output and transmit both channels to each speaker element being used. Additionally, as still another example, the electronic audio device may prevent the transmission of any audio signals to, or "mute," one or more of the speaker elements. For instance, in the event the user is not using one or more of the speaker elements, the electronic audio device may refrain from providing, or "disable," the audio output to any unused speaker element to reduce power consumption.

As such, the techniques of this disclosure may provide a number benefits. For example, the techniques may enable a user of an electronic audio device to correctly perceive an audio output provided to the user by the electronic audio device via a headphone set irrespective of the orientation of one or more speaker elements of the headphone set relative to the user's ears. Thus, the disclosed techniques may simplify the use of the headphone set and the electronic audio device from the standpoint of the user, such that the user may be able to use the headphone set in any of multiple orientations with respect to the user's ears. The techniques may also simplify the design and manufacturing of the headphone set by enabling the use of common materials, components, and techniques (e.g., using a common injection mold, machine milling or 3-D printing profile, and/or labeling process) to fabricate multiple types of (e.g., both right and left) speaker elements, or earpieces, of the headphone set. As such, the headphone set according to the techniques of this disclosure may include symmetry with respect to its speaker elements, or earpieces, allowing each of one or more of the speaker elements to be used with either a right or a left ear of a user. Furthermore, the disclosed techniques may also enhance the user's experience by enabling the electronic audio device to modify the audio output provided to the user via the headphone set based on the manner in which the user uses the headphone set, as illustrated above. Additionally, the techniques may also enable the reduction of power consumption by the electronic audio device and the headphone set in some cases, as also previously described.

The techniques of this disclosure make use of a number of physiological and anatomical characteristics of the human ear. As one example, as described below with reference to FIG. 2, the outer portion of each of the right and left human ears, commonly referred to as the "pinna" or "auricle," includes characteristic features that render the ear asymmetrical with respect to the entry to the ear's canal, commonly referred to as the exterior auditory canal. In particular, as one example, the portion of the auricle located adjacent to one side of the exterior auditory canal, commonly referred to as the "tragus," extends outward and away from the base of the head. In contrast, another portion of the auricle located adjacent to an opposite side of the external auditory canal, commonly referred to as a "cavum concha," forms a depression that extends inward and toward the base of the head.

In surrounding, or "ambient," temperatures lower than the typical, or expected, human body temperature of approximately 37° C./98° F., portions of the human ear that are contiguous with the head, such as the tragus, generally have temperatures that are higher than air spaces surrounding the head, such as the cavum concha. Thus, under these conditions, a temperature read by a temperature sensor located adjacent (e.g., in contact with), or proximate to a tragus of an ear is expected to be greater than a temperature read by a temperature sensor located within, or proximate to, a cavum concha of the same ear. Alternatively, in ambient temperatures greater than the typical human body temperature, the differential temperature relationship described above may be reversed. Specifically, in such instances, homeostasis and temperature regulation may cause the human body to maintain a lower temperature than the ambient temperature. As a result, portions of the ear that are contiguous with the head, such as the tragus, will generally have temperatures that are lower than those of air spaces surrounding the head, such as the cavum concha.

Additionally, because a large portion of the auricle, including the "helix" and the "lobule," or earlobe, is separated, or spaced apart, from the head and is thus farther from the head's primary arterial vasculature, in ambient temperatures below the typical human body temperature, this portion of the auricle is expected to have a lower temperature than portions of the auricle located closer to the head, such as the tragus. Specifically, the tragus is located near the portion of the ear where the auricle attaches to the head and is thus relatively closer to the superficial temporal artery of the head than either of the helix and the earlobe. Moreover, because the same separated portion of the auricle includes a relatively large surface area, it is also subject to relatively greater cooling by convection and radiation compared to portions of the auricle having smaller surface areas and located near the head, such as the tragus. As a result, in ambient temperatures below the typical human body temperature, the temperatures of the helix and the earlobe are also generally expected to be lower than the temperature of the tragus. However, in a similar manner as described above with reference to the tragus and cavum concha, in ambient temperatures greater than the typical human body temperature, this differential temperature relationship may be reversed.

Furthermore, empirical data suggest that the right and left human ears may also exhibit differential temperatures relative to one another, and that these temperatures may vary under certain conditions, such as, e.g., when the body temperature is above or below the typical human body temperature. As one example, "The patient: a novel source of error in clinical temperature measurement using infrared aural thermometry," by Heusch A. I. and McCarthy P. W., reported that, at body temperatures below the typical human body temperature, the temperature of the left ear was significantly lower than the temperature of the right ear, and at body temperatures above the typical human body temperature, the temperature of the right ear was significantly lower than the temperature of the left ear. While the study attributed the observed trends to the health of the study's human test subjects, it is likely that physiological and anatomical aspects of the human body (e.g., asymmetry in the subjects' head vasculature) also form a basis for the observed phenomena.

As explained in greater detail below, the techniques of this disclosure take advantage of the physiological and anatomical characteristics and phenomena associated with the right and left human ears described above to enable the automatic detection, or determination, of whether a speaker element, or earpiece, of a headphone set is located proximate to a right ear, a left ear, or neither ear, of a user of the headphone set based on various types of differential ear temperature of the user and one or more other temperature types (e.g., an ambient temperature and/or a body temperature associated with the user).

In this disclosure, a "headphone set" may refer to any of so-called earphones, headphones, earphone sets, headphone sets, headsets, or equivalent wired and wireless devices or apparatuses that include one or more electroacoustic transducers configured to provide an audio output directly into one or both ears of a user. For example, the headphone set of the techniques described herein may include any of so-called "over-the-ear," "behind-the-neck," and "earbuds" styles of headphone sets, including both wireless and wired implementations thereof Additionally, the headphone set of the present disclosure includes any headsets (e.g., Bluetooth® headsets) that include one or more integrated microphones, such as those used for telecommunications, gaming, and other applications. Furthermore, a "speaker element" of a headphone set as used in this disclosure may refer to an electroacoustic transducer used to generate sound waves at one or more portions of the headphone set. In some examples, speaker element and "earpiece" are used interchangeably. In other instances, an earpiece of a headphone set may include one or more speaker elements and a housing for the speaker elements, and, optionally, other (e.g., electronic) components.

Additionally, in this disclosure, a speaker element of a headphone set being located proximate to, or within, one of a right ear and a left ear of a user of the headphone set may refer to the speaker element being located in a so-called "listening position" with respect to the user. Specifically, as used in this disclosure, the headphone set being located proximate to, or within, one of the right and left ears of the user may refer to the headphone set being located on the user's head, such that the speaker element is pressed against, immediately adjacent to, or slightly inserted into, an external auditory canal of the corresponding ear. In other words, in this context, the speaker element is located within, or nearby, a portion of the corresponding ear commonly referred to as the "outer ear," consistent with the manner in which earbuds and over-the-ear style headphones are generally used.

FIG. 1 is a functional block diagram that illustrates an example of a computing device 100 that may be used to determine whether a speaker element of a headphone set is located proximate to a right ear, a left ear, or neither ear of a user of the headphone set, consistent with the techniques of this disclosure. FIG. 1 depicts only one example of computing device 100. Many other examples of computing device 100 may be used to perform the techniques disclosed herein. Such other examples of computing device 100 may include a subset of the components of computing device 100 depicted in FIG. 1, additional components not shown in FIG. 1, or any combination thereof. As such, although the examples of FIG. 1 and the subsequent FIGS. 2-9 are described with reference to computing device 100 and its various components as depicted in FIG. 1, the techniques of this disclosure are not limited to the example of computing device 100 shown in FIG. 1.

As shown in FIG. 1, computing device 100 includes one or more processors 102, processing memory devices 104, storage memory devices 106, input devices 108, output devices 110, communication devices 112, and power sources 114. In the example of FIG. 1, storage memory device(s) 106 further include operating system 118, system settings 120, one or more application modules 122 (e.g., one or more software applications installed on computing device 100), input/output (I/O) modules 124, communication modules 126, and earphone location/orientation module 128. As also shown in FIG. 1, the various components of computing device 100 are interconnected via a communication interface 116 (e.g., a system component interconnect interface, such as a system bus).

Processor(s) 102 may be configured to execute instructions within computing device 100 to implement the functionality of the techniques of this disclosure. For example, processor(s) 102 may process one or more instructions stored in one or more of processing memory device(s) 104 and storage memory device(s) 106. Such instructions may include components of one or more of operating system 118, system settings 120, application module(s) 122, I/O module (s) 124, communication module(s) 126, and earphone location/orientation module 128, and/or any other instructions.

Processing memory device(s) 104 may, in turn, include one or more devices that are intended for temporary, rather than long-term, data storage. Examples of such devices include volatile memory devices that may not maintain data stored therein when the devices are not receiving power. Such devices include random access memory (RAM), dynamic random access memory (DRAM), static random access memory (SRAM), and other types of volatile memory devices known in the art. In some examples, processing memory device(s) 104 may store program instructions used for execution by processor(s) 102. For example, processing memory device(s) 104 may be used by one or more of operating system 118, system settings 120, application module(s) 122, I/O module(s) 124, communication module(s) 126, and earphone location/orientation module 128 to temporarily store information, such as instructions, during program execution by processor(s) 102.

Storage memory device(s) 106 may include one or more computer-readable storage media. For example, storage memory device(s) 106 may be configured for long-term and/or short-term storage of information including, e.g., instructions, data, and other information used by computing device 100. In some examples, storage memory device(s) 106 may include non-volatile storage memory devices, such as magnetic hard disk drives (HDD), solid state disk (SSD) drives, magnetic floppy discs, compact disc read only memory (CD-ROM) discs, flash memory devices (e.g., USB drives and integrated circuit flash memories), programmable ROMs (PROM), electrically programmable ROMs (EPROMs), electrically erasable and programmable ROMs (EEPROMs), and other non-volatile storage devices.

Input device(s) 108, in conjunction with I/O module 124, may receive various types of input from a user or another device (e.g., one or more temperature measurements from one or more temperature sensors disposed in portions of a headphone set, a headphone set signal cord, or an electronic audio device) through tactile, audio, video, or biometric channels, as well as in the form of one or more electrical signals. Examples of input device(s) 108 may include a keyboard, mouse, touchscreen, microphone, still and/or video camera, fingerprint reader, retina scanner, or other device capable of detecting an input from a user or another device, and relaying the input to computing device 100 or its components. Another example of input device(s) 108 includes an analog or digital interface configured to communicate with one or more temperature sensors, such as p-n junction-, thermocouple-, or thermistor-based temperature sensors, or other temperature sensor types, thus enabling computing device 100 to receive one or more temperature measurements from the temperature sensors.

Output device(s) 110, in conjunction with I/O module 124, may be configured to provide various types of output to a user or another device (e.g., bias or control signals to one or more of the temperature sensors described above with reference to input device(s) 108) through visual, auditory, or tactile channels, or in the form of one or more electrical signals. For example, output device(s) 110 may include a video graphics adapter card, a liquid crystal display (LCD) monitor, a light emitting diode (LED) monitor, a cathode ray tube (CRT) monitor, a sound card, a speaker, or other device capable of generating an output that may be intelligible to a user. Output device(s) 110 may also include an analog or digital interface configured to communicate with one or more temperature sensors, thus enabling computing device 100 to provide bias or control signals and receive one or more temperature measurements from the temperature sensors, e.g., via input device(s) 108.

In some examples, computing device 100 may use communication device(s) 112, in conjunction with communication module 126, to communicate with other devices via one or more wired or wireless networks. Communication device (s) 112 may include a network interface device, such as an Ethernet of WiFi® interface card, an optical transceiver, a radio frequency transceiver, or any other device capable of sending and receiving information to facilitate exchange of information with one or more other devices. Additionally, power source(s) 114 may include any combination of one or more power supplies or power-conversion devices capable of providing operating power to one or more components of computing device 100, including any combination of battery-based, off-line, DC/DC, switch-mode, and linear voltage regulators and controllers.

In general, earpiece location/orientation module 128 may include any suitable arrangement of hardware, software, firmware, or any combination thereof, to perform the techniques attributed to earpiece location/orientation module 128 in this disclosure, namely determining whether a speaker element of a headphone set is located proximate to a right ear, a left ear, or neither ear of a user of the headphone set. For example, although shown in FIG. 1 as part of storage memory device(s) 106, earpiece location/orientation module 128 may include one or more microprocessors, microcontrollers, digital signal processors (DSPs), application specific integrated circuits (ASICs), field programmable gate arrays (FPGAs), or any other equivalent integrated or discrete logic circuitry, as well as any combination thereof. Earpiece location/orientation module 128 may further include various types of analog circuitry, in addition to, or in place of, the logic devices and circuitry described above, and any number of mechanical, electro-mechanical, or structural hardware and components.

In some examples, earpiece location/orientation module 128 may include one or more program instructions used for execution by processor(s) 102 to implement the above-described techniques of determining whether a speaker element of a headphone set is located proximate to a right ear, a left ear, or neither ear of a user of the headphone set. For example, the one or more program instructions, when executed by processor(s) 102, may direct one or more of processor(s) 102, input device(s) 108, output device(s) 110, and communication device(s) 112 (e.g., in conjunction with processing memory device(s) 104 and storage memory device(s) 106 and components thereof), to receive a first temperature value from a first temperature sensor, receive a second temperature value from a second temperature sensor, and determine whether the speaker element is located proximate to the right ear, left ear, or neither ear, based on the first and second temperature values, as described herein.

Operating system 118 may direct one or more functionalities of computing device 100 and/or its components. For example, operating system 118 may interact with any of application module(s) 122, I/O module(s) 124, communication module(s) 126, and earphone location/orientation module 128, and may facilitate one or more interactions between the modules and any of processor(s) 102, input device(s) 108, output device(s) 110, and communication device(s) 112. Although not shown in FIG. 1, operating system 118 may interact with, or be otherwise coupled to, any of the modules described above, as well as to any components thereof. In some examples, one or more of the modules described above may be included within, or be otherwise provided by, operating system 118. Additionally, system settings 120 may be used by operating system 118 to initialize and/or update various system settings of computing device 100.

In general, computing device 100 may include any combination of one or more processors, including any of microprocessors, microcontrollers, DSPs, FPGAs, and ASICs. Computing device 100 may also include various storage memory devices, both static, such as HDDs, SSD drives, optical drives, and FLASH memory, and dynamic, such as RAM, DRAM, and SRAM. As such, computing device 100 may include any of hardware, software, and firmware elements, alone or in any combination, to implement the various aspects and features described in this disclosure. Thus, the techniques of this disclosure should not be strictly limited to any particular embodiment described herein.

In this manner, computing device 100 of FIG. 1 represents an example of an apparatus for determining whether a speaker element of a headphone set is located proximate to a right ear, a left ear, or neither ear of a user of the headphone set, including a computing device configured to receive a first temperature value from a first temperature sensor, receive a second temperature value from a second temperature sensor, and determine whether the speaker element is located proximate to the right ear, left ear, or neither ear, based on the first and second temperature values. In this example, the first and second temperature sensors may be different temperature sensors.

Figure 2:
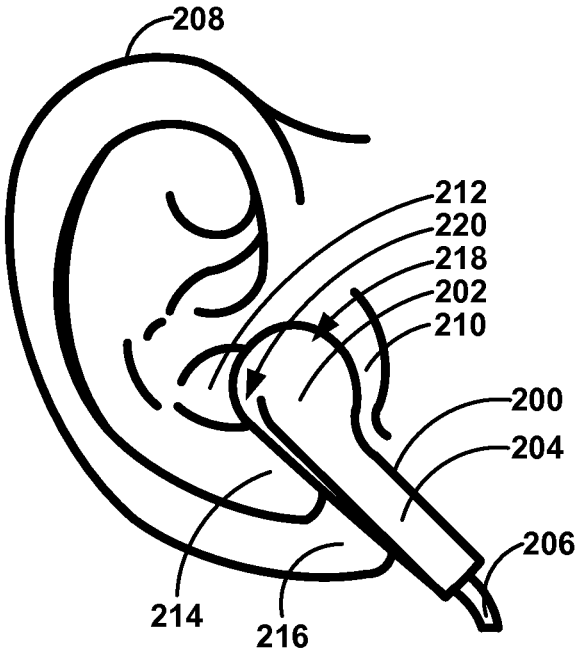
FIG. 2 is a conceptual diagram that illustrates an example of a speaker element of an "earbuds" style headphone set located proximate to an ear of a user of the headphone set, consistent with the techniques of this disclosure.

FIG. 2 is a conceptual diagram that illustrates an example of a speaker element of an earbuds style headphone set located proximate to an ear of a user of the headphone set, consistent with the techniques of this disclosure. As shown in FIG. 2, headphone set 200 includes an earpiece portion 202, a body portion 204, and a signal cord portion 206. Although not shown in FIG. 2, earpiece portion 202 may house one or more miniature electroacoustic transducers, which may be referred to herein as speaker elements, used by headphone set 200 to produce an audio output. Additionally, earpiece portion 202 and/or body portion 204 may house various types of electrical and/or electronic circuitry and associated components (not shown for simplicity) necessary to receive an electrical signal and convert it into an audio signal using the one or more speaker elements, thereby producing the audio output. Furthermore, signal cord portion 206 may communicatively couple headphone set 200 to other devices (also not shown for simplicity), such as electronic audio devices (e.g., portable audio players), facilitating the transmission of the electrical signal, and, optionally, other information (e.g., various audio data, device status, or control information) between the devices and headphone set 200. In other examples, signal cord portion 206 may be replaced by a wireless receiver or transceiver portion of headphone set 200, thus enabling headphone set 200 to wirelessly communicate with other devices in substantially the same manner as described above.

As shown in FIG. 2, headphone set 200 is located proximate to, or within, an outer portion of a right ear 208 (commonly referred to as a "pinna" or "auricle") of a user. Specifically, as shown in FIG. 2, earpiece portion 202 of headphone set 200 is partially inserted into an external auditory canal, or "meatus," of right ear 208 (not shown; obscured by earpiece portion 202). Additionally, as also shown in FIG. 2, an upper part of body portion 204 of headphone set 200 (i.e., the part closest to earpiece portion 202) rests in an intertragic notch portion of right ear 208 (also not shown; obscured by body portion 204). The intertragic notch is an area of right ear 208 surrounded by a tragus 210 portion (to the right of and above the upper part of body portion 204) and an antitragus 214 portion (to the left of and below the upper part of body portion 204) of right ear 208. As further shown in FIG. 2, signal cord portion 206 of headphone set 200 extends outward from body portion 204. In other examples, signal cord portion 206 may extend beyond the distance shown in FIG. 2, may merge with other signal cords (e.g., from another component of headphone set 200), and may terminate at an audio connector or a similar device. As such, earpiece portion 202, body portion 204, and signal cord portion 206 positioned proximate to, or within, right ear 208 in the manner shown in FIG. 2 may define a so-called "right earpiece" of headphone set 200. Although not shown in FIG. 2, headphone set 200 may also include additional components analogous to earpiece portion 202, body portion 204, and signal cord portion 206, that may define a so-called "left earpiece" of headphone set 200 that may be placed proximate to, or within, an outer portion of a left ear of the user in a similar manner as shown in FIG. 2. In some examples, the right and left earpieces may have a same or similar shape.

As illustrated in FIG. 2, right ear 208 includes a number of characteristic features, including tragus 210, which is located to the right of the external auditory canal and protrudes outward from the plane of FIG. 2, and a cavum concha 212 portion, which is located to the left of the external auditory canal and forms a depression that extends inward with respect to the plane. As described above, right ear 208 also includes antitragus 214, which is located substantially opposite tragus 210 across the intertragic notch and also protrudes outward from the plane of FIG. 2, and a lobe, or lobule 216 portion (commonly referred to as "earlobe"), which is located directly below antitragus 214. Description of other features of right ear 208 also shown in FIG. 2 will be omitted for simplicity.

The following discussion will focus largely on tragus 210 and cavum concha 212, although other features of right ear 208 may be similarly used to implement the disclosed techniques in other examples. Tragus 210 and cavum concha 212 of FIG. 2 represent examples of locations within, or features of, right ear 208 that may be used to determine whether headphone set 200 is located proximate to, or within, right ear 208, another ear (e.g., a left ear), or neither ear, consistent with the techniques of this disclosure.

As one example, according to the techniques disclosed herein, a first temperature sensor (not shown) may be integrated into earpiece portion 202 at or near location 218, as depicted in FIG. 2. As a result, when headphone set 200 is located proximate to, or within, right ear 208 (i.e., is in a listening position), the first temperature sensor may provide a temperature reading that is representative of the temperature at or near tragus 210. For example, the first temperature sensor may be disposed at or near the surface of earpiece portion 202, such that the sensor makes contact with, or comes within close proximity to, tragus 210 when headphone set 200 is located proximate to, or within, right ear 208. Similarly, a second temperature sensor (also not shown) may be integrated into earpiece portion 202 at or near location 220, as also shown in FIG. 2. In this case, when headphone set 200 is located proximate to, or within, right ear 208, the second temperature sensor may provide a temperature reading that is representative of the temperature at or near cavum concha 212. In a similar manner as described above with reference to the first temperature sensor, the second temperature sensor may be disposed at or near the surface of earpiece portion 202, such that, when headphone set 200 is located proximate to, or within, right ear 208, the sensor measures a temperature within, or in close proximity to, the depression of right ear 208 formed by cavum concha 212.

Additionally, also in this example, the first and second temperature sensors may be disposed symmetrically at locations 218 and 220 such that, when headphone set 200 is located proximate to, or within, another ear, e.g., a left ear, of the user or of another user, the spatial relationship of the first and second temperature sensors with respect to tragus 210 and cavum concha 212 described above is reversed. In other words, when headphone set 200 is located proximate to, or within, a left ear (not shown) that has analogous, albeit spatially interchanged, tragus and cavum concha portions, the first temperature sensor may provide a temperature reading that is representative of the temperature at or near the cavum concha portion, and the second temperature sensor may provide a temperature reading that is representative of the temperature at or near the tragus portion, of the left ear.

As previously explained, in ambient temperatures lower than the typical, or expected, human body temperature of approximately 37° C./98° F., portions of right ear 208 that are contiguous with the user's head, such as tragus 210, generally have temperatures that are higher than air spaces surrounding the head, such as cavum concha 212. As such, under these conditions, the temperature read by the first temperature sensor is expected to be greater than the temperature read by the second temperature sensor. Alternatively, in ambient temperatures greater than the typical human body temperature, the temperature read by the first temperature sensor is expected to be less than the temperature read by the second temperature sensor. In such cases, as a result of homeostasis and temperature regulation, the user's body will work to maintain a lower temperature than the ambient temperature, resulting in portions of right ear 208 that are contiguous with the user's head generally having temperatures that are lower than those of air spaces surrounding the head. Additionally, irrespective of ambient and body temperatures, in the event headphone set 200 is not located proximate to, or within, right ear 208 (i.e., is not in the listening position), the temperatures read by the first and second temperature sensors are expected to be substantially the same. In such instances, both the first and second temperature sensors are expected to measure an ambient temperature, rather than a temperature of any part of the user's body.

In this manner, the techniques of this disclosure may enable automatic determination of whether a speaker element of headphone set 200 is located proximate to, or within, right ear 208, a left ear of the user or another user, or neither ear, based on temperature values measured using the first and second temperature sensors disposed within earpiece portion 202 of headphone set 200, and, optionally, user ambient temperature and user body temperature (e.g., estimated or measured) values. For example, a difference between the temperature values measured using the first and second temperature sensors may be calculated and compared to a first predetermined threshold value (e.g., 0° C., or a range of −5° C. to +5° C., or −0.5° C. to +0.5° C., to mask insignificant differences between the temperature values, as some examples), to determine whether one temperature value is greater than the other temperature value. Subsequently, a third temperature value measured using a third temperature sensor and representative of a user ambient temperature may be compared to a second predetermined threshold value representative of an estimated or actual user body temperature to determine whether the user ambient temperature is greater or less than the user body temperature. In the event the user ambient temperature is determined to be equal to the user body temperature, the determination of speaker element location and/or relative orientation may be suspended or delayed until a differential temperature between the user ambient temperature and the user body temperature is present. Alternatively, the determination may proceed using the same approach as that taken when the user ambient temperature is greater or less than the user body temperature, in some examples. In any case, based on the outcome of each comparison and the known physiological and anatomical properties and phenomena related to the human ear described above, the location and/or relative orientation of the speaker element of headphone set 200 may be determined.

Locations 218 and 220 may correspond to any portions or regions of earpiece portion 202 and/or body portion 204 that allow for the arrangement of the first and second temperature sensors described herein. As one example, locations 218 and 220 may be chosen such that the first and second temperature sensors are located at substantially opposite sides of a circular plane that is centered about a speaker element housed within earpiece portion 202 and is substantially orthogonal to a direction in which the speaker element emits sound (i.e., inward in the plane of FIG. 2). In another example, the first and second temperature sensors may be disposed within earpiece portion 202 such that, when the speaker element is located proximate to, or within, either one of right ear 208 and the user's left ear, the sensors are located at substantially opposite sides of an opening to an external auditory canal of the corresponding ear. In still another example, the first and second temperature sensors may be disposed at locations 218 and 220 such that, when headphone set 200 is located proximate to, or within, right ear 208, the first temperature sensor is relatively closer to tragus 210 than the second temperature sensor, and when headphone set 200 is located proximate to the user's left ear, the second temperature sensor is relatively closer to a tragus portion of the left ear analogous to tragus 210 than the first temperature sensor.

Furthermore, any of the first and second temperature sensors may include individual temperature sensors, or one or more arrays of temperature sensors, located at or proximate to the corresponding ones of locations 218 and 220. For example, the first temperature sensor may include one or more temperature sensors disposed along a first portion of earpiece portion 202. Similarly, the second temperature sensor may include one or more temperature sensors disposed along a second portion of earpiece portion 202. In this example, the first and second portions of earpiece portion 202 may correspond to right and left halves of a circumference defined by the circular geometry of earpiece portion 202 and bisected by an axis defined by body portion 204, as shown in FIG. 2. In examples where arrays of temperature sensors are used for one or more of the first and second temperature sensors, multiple temperature measurement values may be averaged or combined in another manner to generate the temperature values corresponding to the respective ones of the first and second temperature sensors. In this manner, the temperature values may each represent a spatial average, or another aggregation or combination, of the multiple temperature measurement values received from the corresponding array of temperature sensors.

As another example, according to the techniques of this disclosure, alternatively, the first temperature sensor may be integrated into earpiece portion 202 of headphone set 200 as shown in FIG. 2, while the second temperature sensor may be integrated into an analogous earpiece portion of another component of headphone set 200 not shown in FIG. 2. For example, the first temperature sensor may be integrated into the so-called right earpiece of headphone set 200 depicted in FIG. 2, while the second temperature sensor may be similarly integrated into a left earpiece of headphone set 200. As a result, when each earpiece of headphone set 200 is located proximate to, or within, the corresponding one of right ear 208 and the left ear (i.e., is in a listening position), the first temperature sensor may provide a temperature reading that is representative of right ear 208, and the second temperature sensor may provide a temperature reading that is representative of the left ear. In this example, the first and second temperature sensors may each be disposed within their respective earpieces, such that each sensor measures a tympanic membrane temperature of the corresponding ear when the earpiece is located proximate to, or within, the ear.

As previously explained, empirical data suggest that the right and left human ears exhibit different temperatures, depending on the body temperature. Specifically, "The patient: a novel source of error in clinical temperature measurement using infrared aural thermometry," by Heusch A. I. and McCarthy P. W., reported that, at body temperatures below the typical human body temperature of approximately 37° C./98° F., the temperature of the left ear of each of multiple human test subjects was significantly lower than the temperature of the right ear of the same test subject, and at body temperatures above the typical human body temperature, the reverse was true. Furthermore, in a similar manner as previously described, irrespective of body temperature, in the event the right and left earpieces of headphone set 200 are not located proximate to, or within, right ear 208 and the left ear (i.e., are not in the listening position), the temperature read by the first and second temperature sensors are expected to be substantially the same. In such instances, both the first and second temperature sensors are expected to measure an ambient temperature, rather than a temperature of any part of the user's body.

In this manner, the techniques of this disclosure may also enable automatic determination of whether a speaker element of headphone set 200 is located proximate to, or within, right ear 208, a left ear of the user or another user, or neither ear, based on temperature values measured using the first and second temperature sensors disposed in different earpieces of headphone set 200, and, optionally, a user body temperature (e.g., estimated or measured) value. For example, a difference between the temperature values measured using the first and second temperature sensors may once again be calculated and compared to a first predetermined threshold value (e.g., 0° C., or a range of −5° C. to +5° C., or −0.5° C. to +0.5° C., to mask insignificant differences between the temperature values, as some examples), to determine whether one temperature value is (e.g., significantly) greater than the other temperature value. Subsequently, a third temperature value measured using a third temperature sensor and representative of a user body temperature may be compared to a second predetermined threshold value representative of a threshold user body temperature (e.g., typical human body temperature) to determine whether the user body temperature is greater or less than the typical human body temperature. In the event the user body temperature is determined to be equal to the threshold user body temperature, the determination of speaker element location and/or relative orientation may be suspended or delayed until a differential temperature between the user body temperature and the threshold user body temperature is present. Alternatively, the determination may proceed using the same approach as that taken when the user body temperature is greater or less than the threshold user body temperature, in some examples. In any case, based on the outcome of each comparison and the known physiological and anatomical properties and phenomena related to the human ear described above, the location and/or relative orientation of the speaker element of headphone set 200 may be determined.

In examples where the first and second temperature sensors are both disposed in earpiece portion 202, the third temperature sensor may be located anywhere within earpiece portion 202, body portion 204, signal cord portion 206, an electronic audio device communicatively coupled to headphone set 200, or elsewhere sufficiently proximate to the user to measure the user's surrounding, or ambient, temperature. In these examples, the third temperature sensor may be configured to measure an ambient temperature of air spaces immediately surrounding right ear 208. Alternatively, in the example where the first and second temperature sensors are disposed in different earpieces of headphone set 200, the third temperature sensor may be configured to measure the user's body temperature, such as, e.g., the user's tympanic membrane temperature, in a similar manner as described below with reference to the fourth temperature sensor.

In some examples, a fourth temperature sensor may be located anywhere within, on, or proximate to, the user so as to measure the user's body temperature. As one example, the fourth temperature sensor may also be disposed within headphone set 200, e.g., within earpiece portion 202, such that the fourth temperature sensor measures the temperature of the user's tympanic membrane, which is generally thought to be representative of body temperature. The user's body temperature, may, in turn, be used directly or indirectly to derive the second predetermined threshold value described above in some examples. For instance, in examples where the first and second temperature sensors are both disposed in earpiece portion 202, the user ambient temperature measured by the third temperature sensor may be compared against an actual body temperature of the user measured by the fourth temperature sensor (i.e., against the second predetermined threshold value derived using the actual user body temperature), rather than the typical human body temperature, which may lead to greater accuracy in performing the comparison.

In the examples provided above, any of the first, second, third, and fourth temperature sensors may include any combination of one or more p-n junctions of a diode or a bipolar junction transistor (BJT) device, thermocouple (e.g., J, K, or other types) wires or probes, thermistor (e.g., positive thermal coefficient (PCT), or negative thermal coefficient (NTC) thermistors) devices, or any equivalent or other devices or apparatuses capable of measuring temperature in the manner described above. In each case, any such devices or apparatuses may also include any biasing or signal conditioning circuitry or components necessary for the respective device or apparatus to measure temperature.

In this manner, this disclosure illustrates multiple techniques that may enable automatically determining whether earpiece portion 202, and, therefore, any of one or more speaker elements included therein, of headphone set 200 is located proximate to, or within, right ear 208, a left ear of the user or of another user, or neither ear, based on differential user ear temperature. As explained herein, the differential user ear temperature may refer to a difference in temperature between two characteristic features, or portions, or a particular one of the user's ears, or to a difference in temperature between the user's right and left ears. Additionally, in either case, the above-described determination may be performed using one or more of the following: first and second temperature sensors configured to measure temperatures of portions of a same or different ears, a third temperature sensor configured to measure an ambient temperature or a body temperature of the user, and a fourth temperature sensor configured to measure a body temperature of the user.

Figure 3:
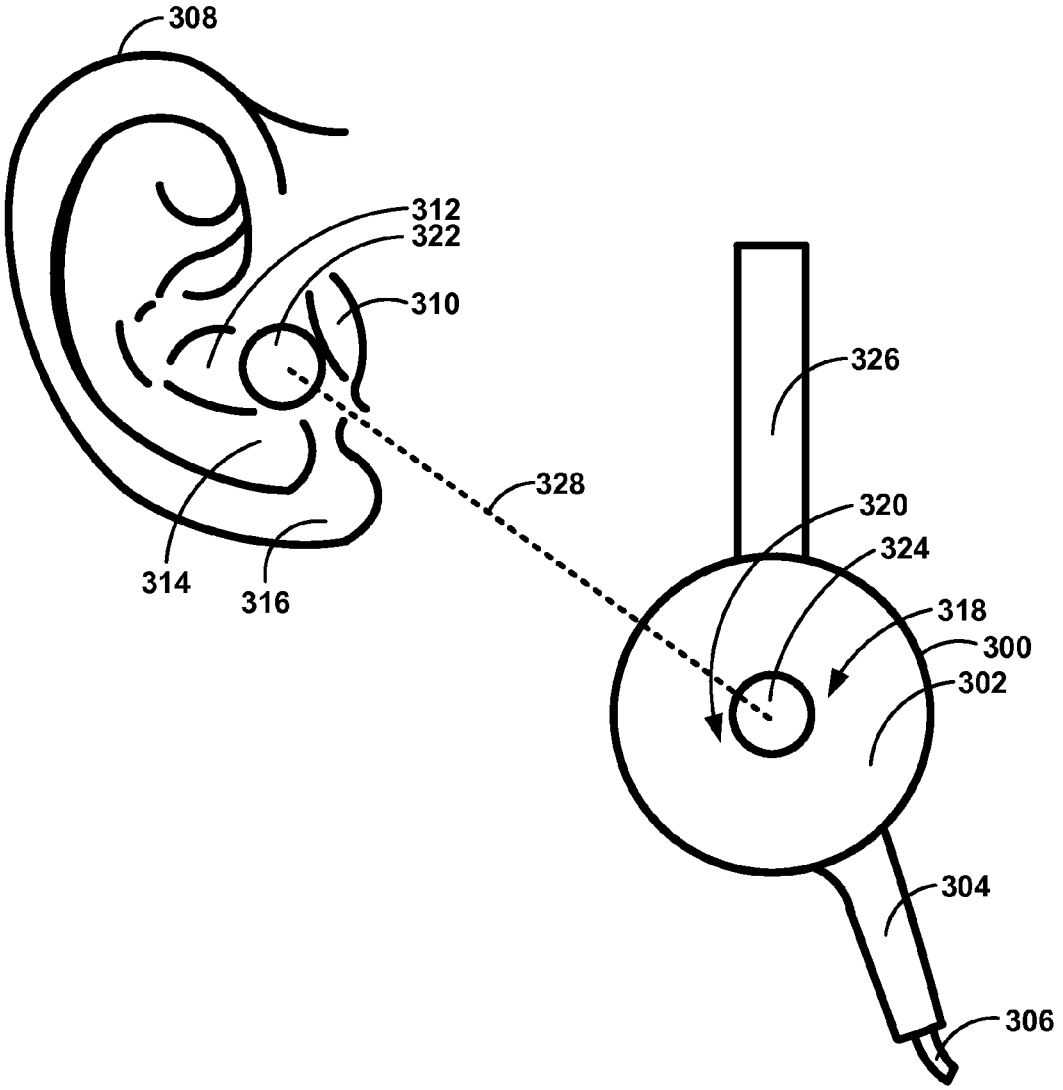
FIG. 3 is a conceptual diagram that illustrates an example of a speaker element of an "over-the-ear" style headphone set located proximate to an ear of a user of the headphone set, consistent with the techniques of this disclosure.

FIG. 3 is a conceptual diagram that illustrates an example of a speaker element of an over-the-ear style headphone set located proximate to an ear of a user of the headphone set, consistent with the techniques of this disclosure. The elements of FIG. 3 are largely analogous to those of FIG. 2 described above, although FIG. 3 includes some different and additional elements. For example, as shown in FIG. 3, headphone set 300 includes an earpiece portion 302, a body portion 304, a signal cord portion 306, a speaker element portion 324, and a band portion 326. As shown in FIG. 3, earpiece portion 302 houses speaker element portion 324, which may include one or more miniature electroacoustic transducers, or speaker elements, used by headphone set 300 to produce an audio output. Although not shown in FIG. 3, earpiece portion 302, speaker element portion 324, and/or body portion 304 may house various types of electrical and/or electronic circuitry and associated components (not shown for simplicity) necessary to receive an electrical signal and convert it into an audio signal using speaker element portion 324, thereby producing the audio output. Additionally, signal cord portion 306 may communicatively couple headphone set 300 to other devices (also not shown for simplicity), such as electronic audio devices, thus facilitating the transmission of the electrical signal, and, optionally, other information between the devices and headphone set 300. As before, signal cord portion 306 may be replaced by a wireless receiver or transceiver portion of headphone set 300, thus enabling headphone set 300 to wirelessly communicate with other devices in the manner described above. As also shown in FIG. 3, headphone set 300 further includes a band portion 326, which may enable headphone set 300 to rest atop the user's head when headphone set 300 is located in the listening position with respect to the user.

As illustrated in FIG. 3, headphone set 300 may be located proximate to an outer portion of a right ear 308 of a user. For example, as shown by a connecting line 328 in FIG. 3, when headphone set 300 is in the so-called listening position with respect to right ear 308, earpiece portion 302 of headphone set 300 is proximate to right ear 308, and speaker element portion 324 of earpiece portion 302 at least partially overlaps an external auditory canal 322 of right ear 308. As further shown in FIG. 3, signal cord portion 306 of headphone set 300 extends outward from body portion 304. In other examples, signal cord portion 306 may extend beyond the distance shown in FIG. 3, may merge with other signal cords (e.g., from another component of headphone set 300), and may terminate at an audio connector or a similar device. In this manner, earpiece portion 302, speaker element portion 324, body portion 304, and signal cord portion 306 positioned proximate to right ear 308 in the manner shown in FIG. 3 may define a so-called "right earpiece" of headphone set 300. Although not shown in FIG. 3, headphone set 300 may also include additional components analogous to earpiece portion 302, speaker element portion 324, body portion 304, and signal cord portion 306, e.g., joined to these elements by band 326, that may define a so-called "left earpiece" of headphone set 300 that may be placed proximate to an outer portion of a left ear of the user in a similar manner as shown in FIG. 3. In some examples, the right and left earpieces may be similar or identical in their geometry. Although not shown in FIG. 3, in some examples, each of the right and left earpieces of headphone set 300 may be symmetrical (e.g., body portion 304 may itself be symmetrical and extend directly downward from earpiece portion 302) and rotatable about band portion 326 so as to allow headphone set 300 to be placed into a substantially identical listening position for either orientation of the right and left earpieces with respect to the user's right and left ears.

As in the example of FIG. 2, right ear 308 includes a number of characteristic features, including a tragus 310 portion, which is located to the right of external auditory canal 322 and protrudes outward from the plane of FIG. 3, and a cavum concha 312 portion, which is located to the left of external auditory canal 322 and forms a depression that extends inward with respect to the plane. Similarly, right ear 308 also includes an antitragus 314 portion, which is located substantially opposite tragus 310 across an intertragic notch (not labeled for simplicity) and also protrudes outward from the plane of FIG. 3, and a lobe 316 portion, which is located directly below antitragus 314. Description of other features of right ear 308 also shown in FIG. 3 will be omitted for simplicity.

In a similar manner as described above with reference to FIG. 2, in the example of FIG. 3, the first and second temperature sensors may be located anywhere within one or both of earpiece portion 302 and speaker element portion 324. As an example, the first temperature sensor (not shown) may be integrated into earpiece portion 302 and/or speaker element portion 324 at or near location 318, as shown in FIG. 3, such that, when headphone set 300 is located proximate to right ear 308, the first temperature sensor may provide a temperature reading that is representative of the temperature at or near tragus 310. The first temperature sensor may be disposed at or near the surface of earpiece portion 302 facing right ear 308, such that the sensor makes contact with, or comes within close proximity to, tragus 310 when headphone set 300 is located proximate to right ear 308. In a similar manner, a second temperature sensor (also not shown) may be integrated into earpiece portion 302 and/or speaker element portion 324 at or near location 320, as also shown in FIG. 3, such that when headphone set 300 is located proximate to right ear 308, the second temperature sensor may provide a temperature reading that is representative of the temperature at or near cavum concha 312. As before, the second temperature sensor may be disposed at or near the surface of earpiece portion 302 facing right ear 308, such that, when headphone set 300 is located proximate to right ear 308, the sensor measures a temperature within, or proximate to, the depression of right ear 308 formed by cavum concha 312.

Also in this example, the first and second temperature sensors may be disposed symmetrically at locations 318 and 320 such that, when headphone set 300 is located proximate to another ear, e.g., a left ear, of the user or of another user, the above-described spatial relationship of the first and second temperature sensors with respect to tragus 310 and cavum concha 312 is reversed. Stated another way, when headphone set 300 is located proximate to a left ear (not shown) that has analogous, albeit spatially interchanged, tragus and cavum concha portions, the first temperature sensor may provide a temperature reading that is representative of the temperature at or near the cavum concha portion, and the second temperature sensor may provide a temperature reading that is representative of the temperature at or near the tragus portion, of the left ear.

Additionally, the geometry of earpiece portion 302 of headphone set 300 shown in FIG. 3 allows for the first and second temperature sensors to be placed radially farther outward from speaker element portion 324, compared to the example of FIG. 2. As such, locations 318 and 320 of the first and second temperature sensors may vary in that the sensors need not be disposed directly adjacent to speaker element 324, but rather can be located elsewhere within earpiece portion 302. As a result, in the example of FIG. 3, earpiece portion 302 being located proximate to right ear 308 may result in the first temperature sensor being located adjacent, or proximate to, a top center portion of tragus 310 in the plane of FIG. 3, and the second temperature sensor being within, or proximate to, cavum concha 312, or other features of right ear 308 with similar properties as cavum concha 312, such as depressions formed by the features commonly referred to as "cymba concha," "fossa," and "scaffa" (not labeled for simplicity), as some examples. Also in a similar manner as described above with reference to FIG. 2, in the example of FIG. 3, alternatively, the first temperature sensor may be integrated into one or more of earpiece portion 302 and speaker element portion 324 of headphone set 300, while the second temperature sensor may be integrated into an analogous earpiece portion or speaker element portion of another (e.g., a left) earpiece of headphone set 300 not shown in FIG. 3.

In the example of FIG. 3, earpiece portion 302 being located proximate to right ear 308 may result in the air spaces located between right ear 308 and earpiece portion 302 having one or more temperatures that are significantly different from the ambient temperature, e.g., that of air spaces surrounding the user's head. In such cases, the third temperature sensor described above may be located within earpiece portion 302 such that it measures the temperature of the airspaces between earpiece portion 302 and right ear 308, or areas proximate to the airspaces. In general, in the example of FIG. 3, the third and fourth temperature sensors may be disposed in a similar manner as described above with reference to FIG. 2, and their respective temperature measurements can be used to determine speaker element location and/or relative orientation in a similar manner as previously described.

In this manner, each of FIGS. 2 and 3 represents an example of an apparatus for determining whether a speaker element of a headphone set is located proximate to a right ear, a left ear, or neither ear of a user of the headphone set, including a computing device configured to receive a first temperature value from a first temperature sensor, receive a second temperature value from a second temperature sensor, and determine whether the speaker element is located proximate to the right ear, left ear, or neither ear, based on the first and second temperature values. In one or more of these examples, the first and second temperature sensors may be different temperature sensors.

Figure 6:
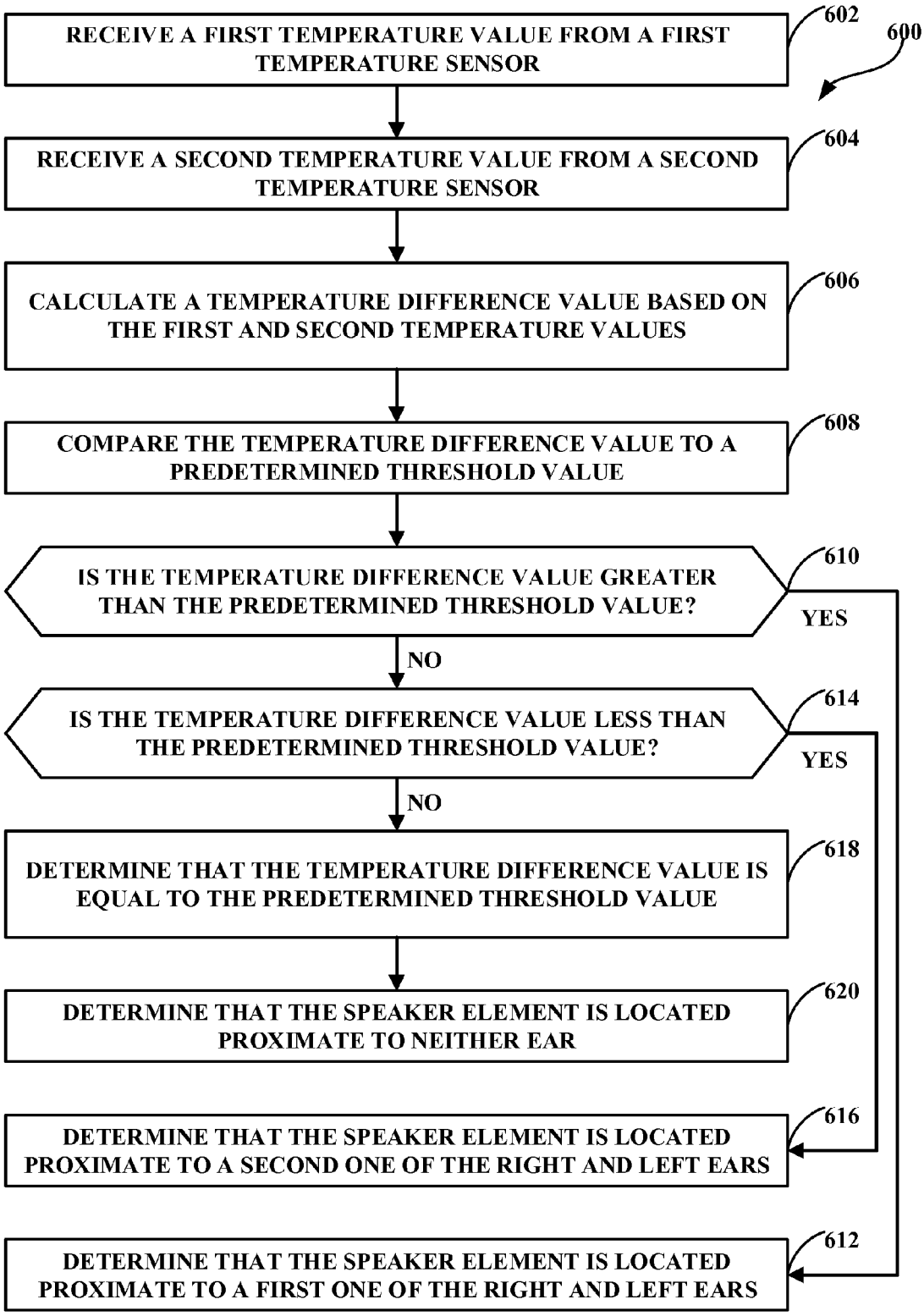
Figure 7:
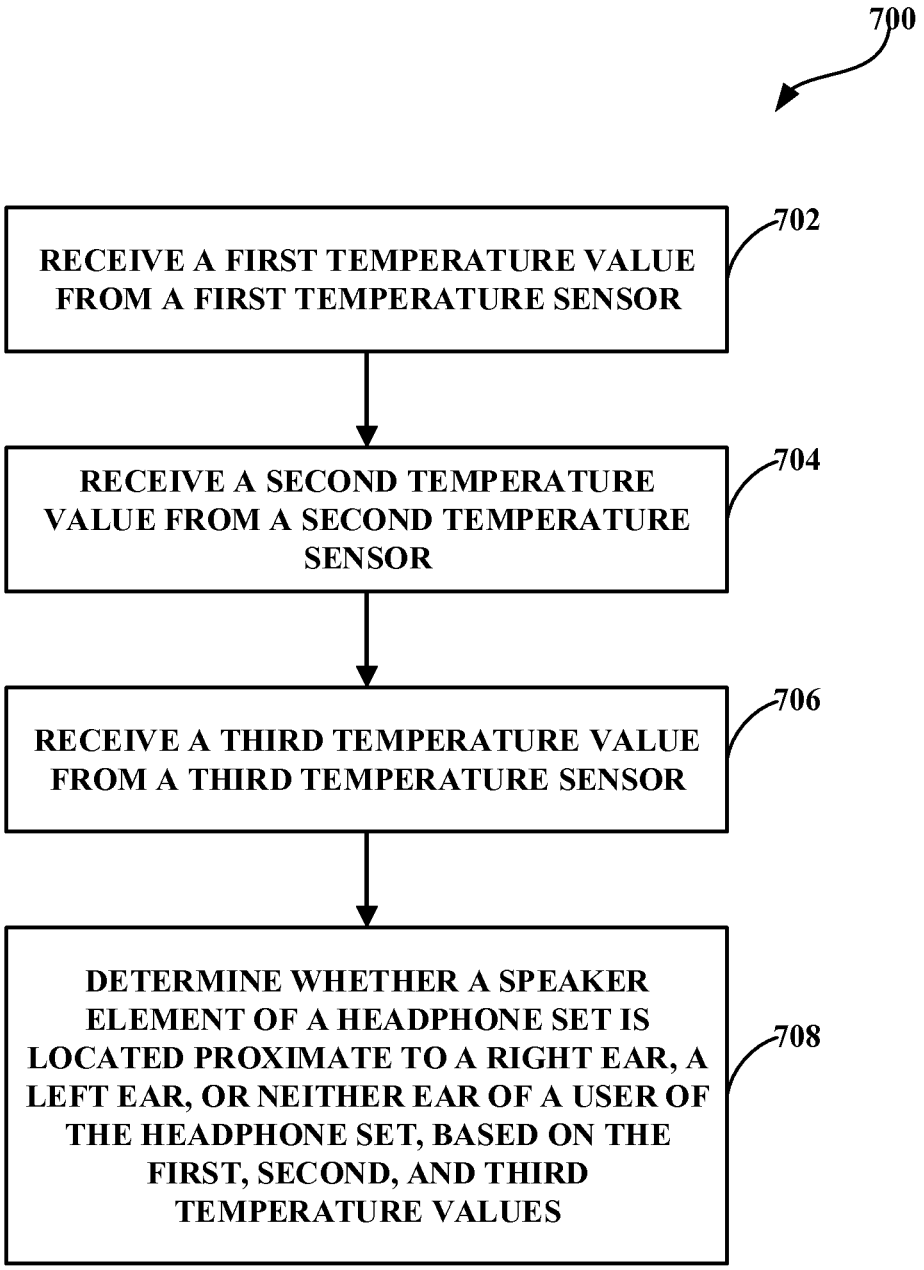
Figure 8:
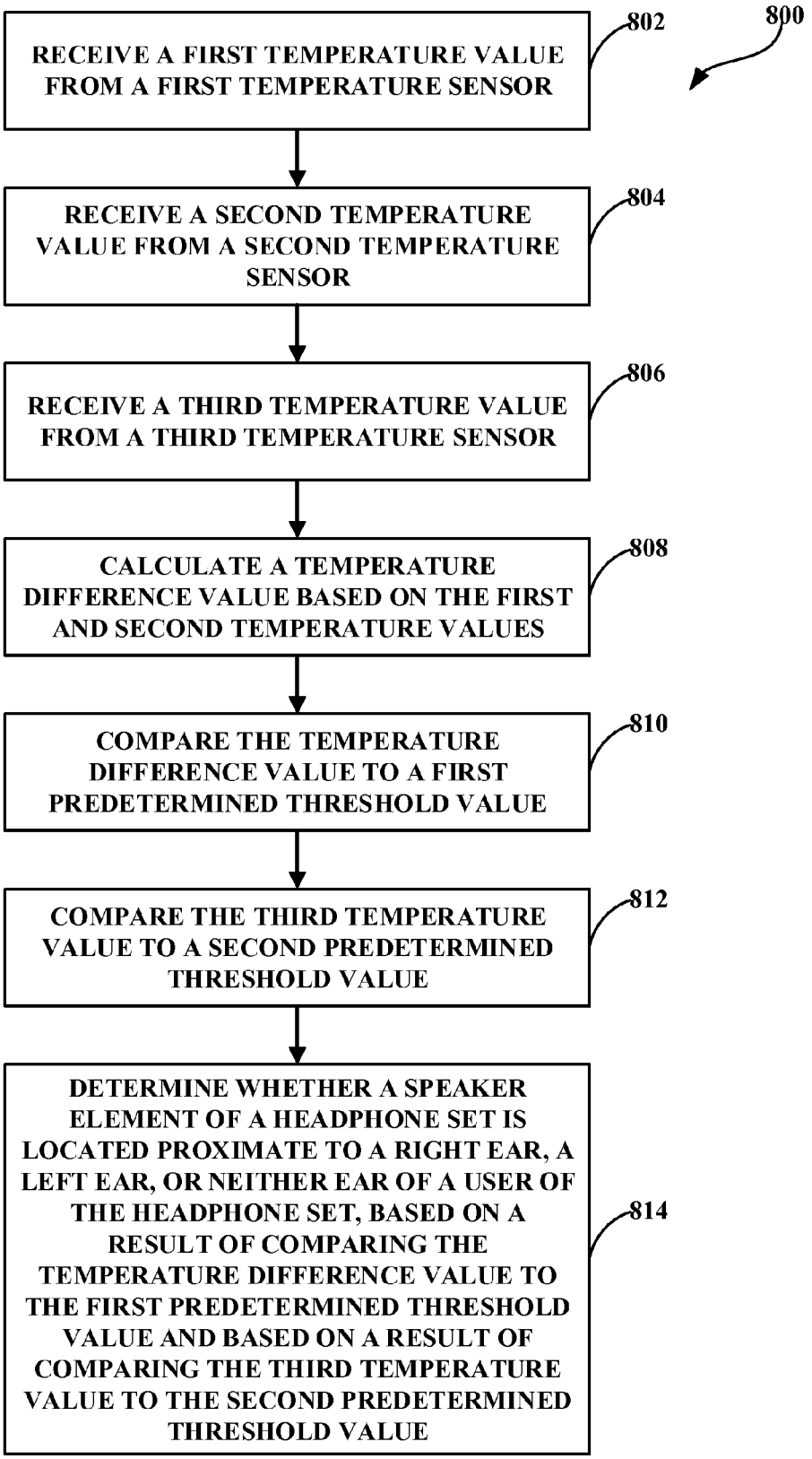
Figure 9:
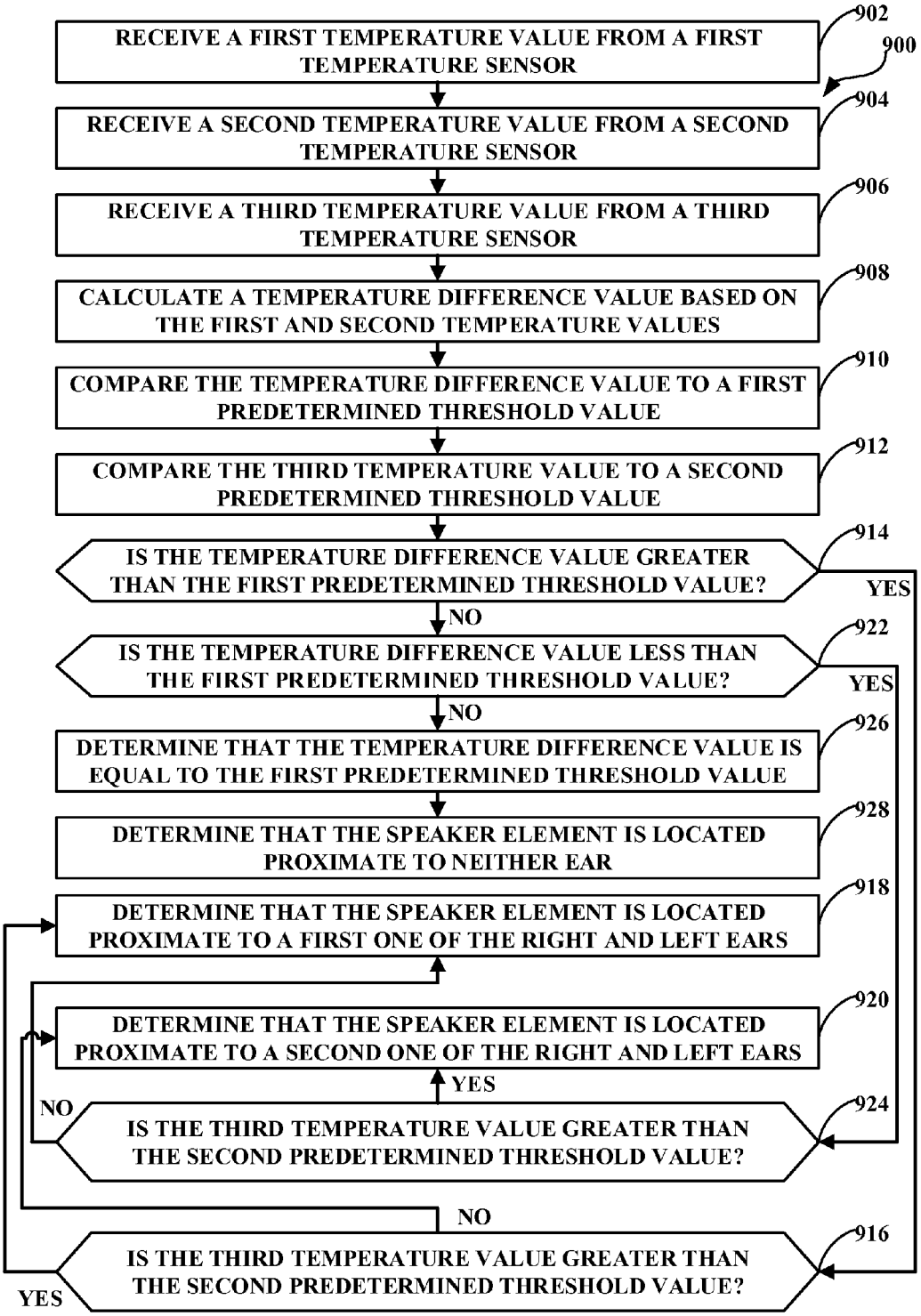

FIGS. 4-9 depict flow diagrams 400, 500, 600, 700, 800, and 900, each of which illustrates an example of a method of determining whether a speaker element of a headphone set is located proximate to a right ear, a left ear, or neither ear of a user of the headphone set, consistent with the techniques of this disclosure. Specifically, the example methods of FIGS. 4-6 include the use of first and second temperature sensors to perform the above-described determination, whereas the example methods of FIGS. 7-9 include the use of an additional third temperature sensor, such as, e.g., an ambient temperature sensor or a body temperature sensor, to perform such a determination. In particular, FIGS. 5 and 6 each illustrate specific examples of one or more aspects of the example method of FIG. 4. Similarly, FIGS. 8 and 9 provide specific examples of certain aspects of the example method illustrated in FIG. 7.

As described above with reference to FIGS. 2 and 3, the first and second temperature sensors may be located within a single speaker element, or a housing thereof (e.g., within an earpiece portion) of the headphone set. Alternatively, as also described above, each of the first and second temperature sensors may be located within a different speaker element, or a corresponding housing thereof, of the headphone set. Additionally, as also described above, the third temperature sensor may be located within any of various portions of the headphone set, within an electronic audio device that provides an audio signal to the headphone set, or within a signal cord that communicatively couples the headphone set to the electronic audio device. In other examples, the third temperature sensor may be located anywhere sufficiently proximate to one or more of the headphone set, the electronic audio device, and the user of the headphone set and electronic audio device, to measure the third temperature value such that the value is representative of a user ambient temperature or a user body temperature.

Figure 4:
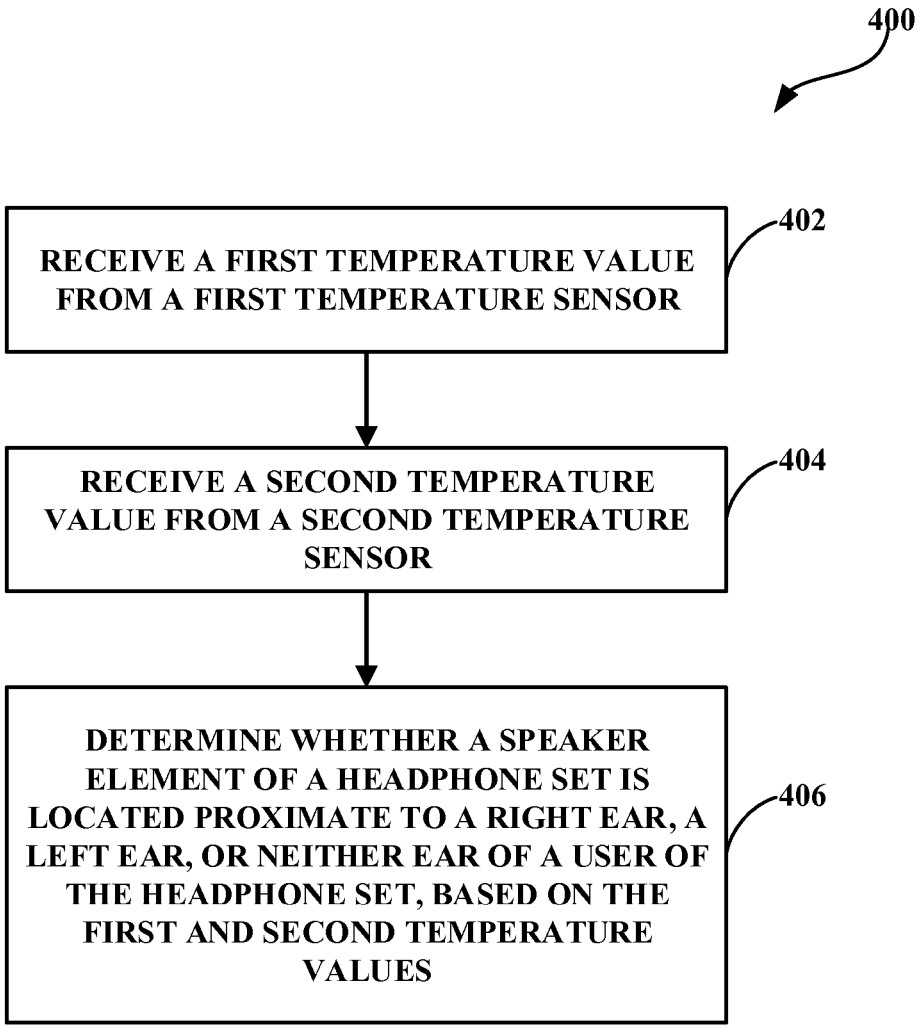
FIGS. 4-9 are flow diagrams each of which illustrates an example of a method of determining whether a speaker element of a headphone set is located proximate to a right ear, a left ear, or neither ear of a user of the headphone set, consistent with the techniques of this disclosure.

FIG. 4 depicts flow diagram 400, which illustrates one example of a method of determining whether a speaker element of a headphone set is located proximate to a right ear, a left ear, or neither ear of a user of the headphone set, consistent with the techniques of this disclosure. As shown in FIG. 4, initially, computing device 100 may receive a first temperature value from a first temperature sensor (402). Computing device 100 may further receive a second temperature value from a second temperature sensor (404). In this example, the first and second temperature sensors may be different temperature sensors. Lastly, computing device 100 may determine whether the speaker element is located proximate to the right ear, left ear, or neither ear, based on the first and second temperature values (406).

In some examples, the first temperature sensor may be located within a first portion of the speaker element and the second temperature sensor may be located within a second portion of the speaker element. In these examples, the first and second portions of the speaker element may be different portions of the speaker element. In these examples, the first and second temperature sensors located within the first and second portions, respectively, of the speaker element may include one or more of the following: (1) the first and second temperature sensors may be disposed within a housing of the speaker element such that the temperature sensors are located at substantially opposite sides of a circular plane that is substantially centered about a portion of the speaker element that emits sound and is substantially orthogonal to a direction in which the speaker element emits sound (e.g., as shown by locations 218, 220, 318, and 320 of FIGS. 2 and 3); (2) the first and second temperature sensors may be disposed within the housing of the speaker element such that, when the speaker element is located proximate to either one of the right and left ears, the temperature sensors are located at substantially opposite sides of an opening to an external auditory canal of the corresponding ear; and (3) the first and second temperature sensors may be disposed within the housing of the speaker element such that, when the speaker element is located proximate to the right ear, the first temperature sensor is relatively closer to a tragus portion of the right ear than the second temperature sensor, and when the speaker element is located proximate to the left ear, the second temperature sensor is relatively closer to a tragus portion of the left ear than the first temperature sensor.

In other examples, the speaker element may be a first speaker element. In these examples, the headphone set may further include a second speaker element that is different than the first speaker element. Also in these examples, the first temperature sensor may be located within the first speaker element, and the second temperature sensor may be located within the second speaker element.

Figure 5:
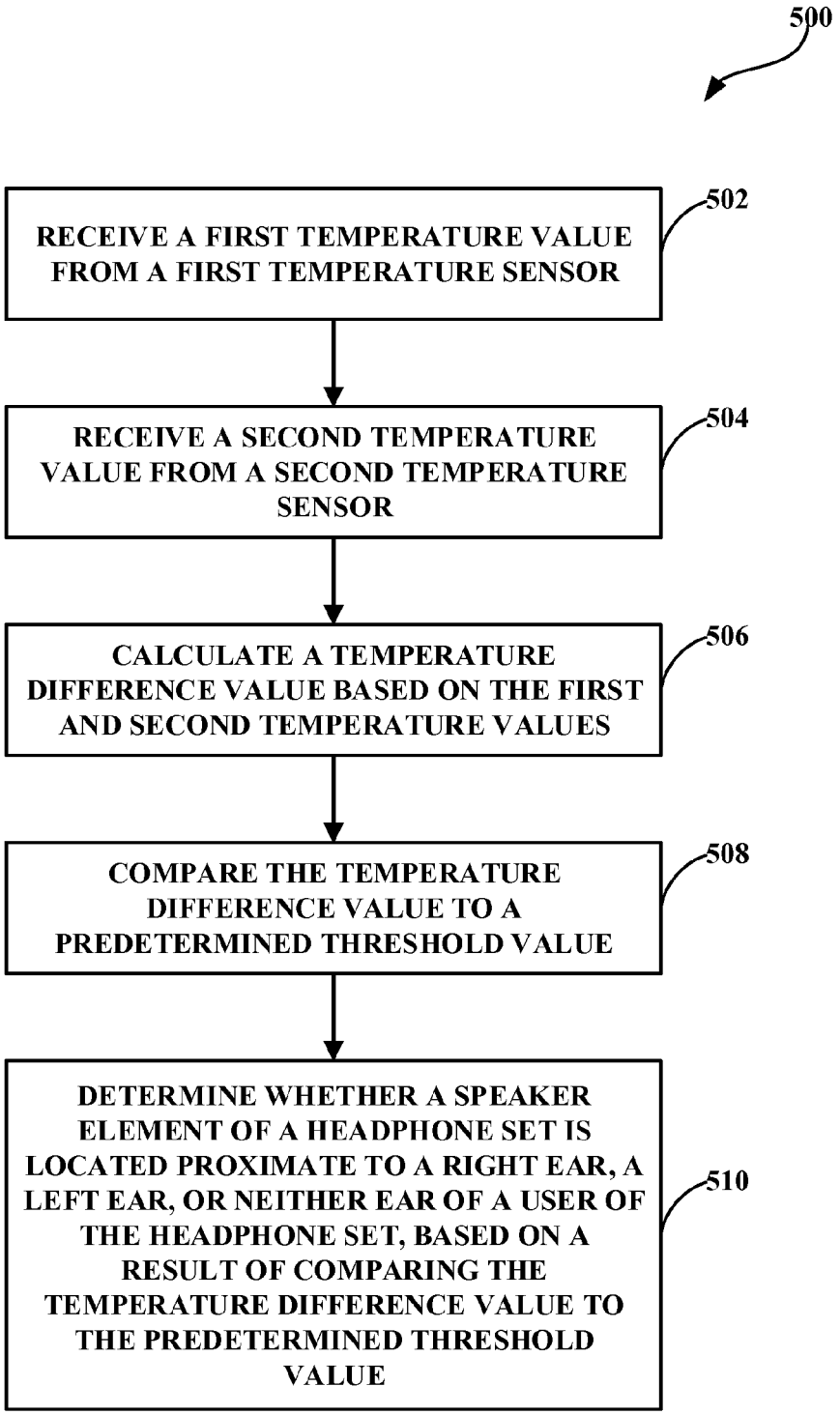

FIG. 5 depicts flow diagram 500, which illustrates a specific example of a method of determining whether the speaker element of FIG. 4 is located proximate to the right ear, left ear, or neither ear, based on the first and second temperature values. As shown in FIG. 5, initially, computing device 100 may perform steps 502 and 504 that are analogous to steps 402 and 404 of flow diagram 400 of FIG. 4. In other words, the remaining steps 506, 508, and 510 of flow diagram 500 described below illustrate a specific example of how computing device 100 may implement step 406 of flow diagram 400 described with reference to FIG. 4.

As shown in FIG. 5, upon receiving the first and second temperature values from the first and second temperature sensors in the manner described above with reference to FIG. 4, computing device 100 may subsequently calculate a temperature difference value based on the first and second temperature values (506). Following this, computing device 100 may compare the temperature difference value to a predetermined threshold value (508). Lastly, computing device 100 may determine whether the speaker element is located proximate to the right ear, left ear, or neither ear, based on a result of comparing the temperature difference value to the predetermined threshold value (510), as described herein.

FIG. 6 depicts flow diagram 600, which illustrates a specific example of a method of determining whether the speaker element of FIGS. 4 and 5 is located proximate to the right ear, left ear, or neither ear, based on the result of comparing the temperature difference value to the predetermined threshold value. As shown in FIG. 6, initially, computing device 100 may perform steps 602, 604, 606, and 608, which are analogous to steps 502-508 of flow diagram 500 of FIG. 5. Additionally, steps 602 and 604 of flow diagram 600 are also analogous to steps 402 and 404 of flow diagram 400 of FIG. 4. In other words, the remaining steps 610, 612, 614, 616, 618, and 620 of flow diagram 600 described below illustrate a specific example of how computing device 100 may implement step 510 of flow diagram 500 previously described with reference to FIG. 5.

As shown in FIG. 6, to determine whether the speaker element is located proximate to the right ear, left ear, or neither ear, based on the result of comparing the temperature difference value to the predetermined threshold value, computing device 100 may first determine whether the temperature difference value is greater than the predetermined threshold value (610). Computing device 100 may, in the event the temperature difference value is greater than the predetermined threshold value ("YES" branch of decision block 610), determine that the speaker element is located proximate to a first one of the right and left ears (612). As also shown , computing device 100 may, in the event the temperature difference value is not greater than the predetermined threshold value ("NO" branch of decision block 610), determine whether the temperature difference value is less than the predetermined threshold value (614). Computing device 100 may, in the event the temperature difference value is less than the predetermined threshold value ("YES" branch of decision block 614), determine that the speaker element is located proximate to a second one of the right and left ears (616). Lastly, as further shown, computing device 100 may, in the event the temperature difference value is not less than the predetermined threshold value ("NO" branch of decision block 614), determine that the temperature difference value is equal to the predetermined threshold value (618), and determine that the speaker element is located proximate to neither ear (620).

In some examples, the predetermined threshold value may include a range of values. In these examples, the temperature difference value being one of greater than and less than the predetermined threshold value may include the temperature difference value corresponding to a value that is outside of the range of values. Also in these examples, the temperature difference value being equal to the predetermined threshold value may include the temperature difference value corresponding to a value that is within the range of values. For instance, the predetermined threshold value may include a range of, e.g., −5° C. to +5° C., or −0.5° C. to +0.5° C., such that any temperature difference values falling within this range (i.e., being equal to the predetermined threshold value) are deemed as insignificant (e.g., possibly caused by electrical noise or transient temperature fluctuations) and are thus masked or ignored for purposes of the above-described determination. In other examples, the predetermined threshold value may be a single value, e.g., 0° C., against which the temperature difference value may be compared. In any case, the purpose of comparing the temperature difference value against the predetermined threshold value is to determine whether the first temperature and the second temperature are different, and, if so, which of the temperature values is greater than the other, as described herein.

FIG. 7 depicts flow diagram 700, which illustrates another example of a method of determining whether a speaker element of a headphone set is located proximate to a right ear, a left ear, or neither ear of a user of the headphone set, consistent with the techniques of this disclosure. As shown in FIG. 7, initially, computing device 100 may perform steps 702 and 704, which are analogous to steps 402 and 404 of flow diagram 400 of FIG. 4. The remaining steps 706 and 708 of flow diagram 700 described below are unique to flow diagram 700 in that they also make use of a third temperature sensor and a third temperature value (e.g., representing a user ambient temperature or a user body temperature) it provides to make the above-described determination of speaker element location and/or orientation.

As shown in FIG. 7, in addition to receiving the first and second temperature values from the first and second temperature sensors, computing device 100 may also receive a third temperature value from a third temperature sensor (706). In a similar manner as described above with reference to FIGS. 4-6, in this example, the first, second, and third temperature sensors may be different temperature sensors. Lastly, in addition to determining whether the speaker element is located proximate to the right ear, left ear, or neither ear, based on the first and second temperature values, computing device 100 may further determine whether the speaker element is located proximate to the right ear, left ear, or neither ear, based on the third temperature value (708), as described herein.

FIG. 8 depicts block diagram 800, which illustrates a specific example of a method of determining whether the speaker element of FIG. 7 is located proximate to the right ear, left ear, or neither ear, based on the first, second, and third temperature values. As shown in FIG. 8, initially, computing device 100 may perform steps 802, 804, and 806, which are analogous to steps 702-706 of flow diagram 700 of FIG. 7. Stated another way, the remaining steps 808, 810, 812, and 814 of flow diagram 800 described below illustrate a specific example of how computing device 100 may implement step 708 of flow diagram 700 previously described with reference to FIG. 7.

As shown in FIG. 8, upon receiving the first, second, and third temperature values from the first, second, and third temperature sensors in the manner described above with reference to FIG. 7, computing device 100 may subsequently calculate a temperature difference value based on the first and second temperature values (808). Following this, computing device 100 may further compare the temperature difference value to a first predetermined threshold value (810). Computing device 100 may also compare the third temperature value to a second predetermined threshold value (812). Lastly, computing device 100 may determine whether the speaker element is located proximate to the right ear, left ear, or neither ear, based on a result of comparing the temperature difference value to the first predetermined threshold value and based on a result of comparing the third temperature value to the second predetermined threshold value (814), as described herein.

FIG. 9 depicts flow diagram 900, which illustrates a specific example of a method of determining whether the speaker element of FIGS. 7 and 8 is located proximate to the right ear, left ear, or neither ear, based on the result of comparing the temperature difference value to the first predetermined threshold value and based on the result of comparing the third temperature value to the second predetermined threshold value. As shown in FIG. 9, initially, computing device 100 may perform steps 902, 904, 906, 908, 910, and 912, which are analogous to steps 802-812 of flow diagram 800 of FIG. 8. Additionally, steps 902, 904, and 906 of flow diagram 900 are also analogous to steps 702-706 of flow diagram 700 of FIG. 7. In other words, the remaining steps 914, 916, 918, 920, 922, 924, 926, and 928 of flow diagram 900 described below illustrate a specific example of how computing device 100 may implement step 814 of flow diagram 800 described above with reference to FIG. 8.

As shown in FIG. 9, to determine whether the speaker element is located proximate to the right ear, left ear, or neither ear, based on the result of comparing the temperature difference value to the first predetermined threshold value and based on the result of comparing the third temperature value to the second predetermined threshold value, computing device 100 may first determine whether the temperature difference value is greater than the first predetermined threshold value (914). Computing device 100 may, in the event the temperature difference value is greater than the first predetermined threshold value ("YES" branch of decision block 914), determine whether the third temperature value is greater than the second predetermined threshold value (916). Computing device 100 may, in the event the third temperature value is greater than the second predetermined threshold value ("YES" branch of decision block 916), determine that the speaker element is located proximate to a first one of the right and left ears (918). Alternatively, computing device 100 may, in the event the temperature difference value is greater than the first predetermined threshold value ("YES" branch of decision block 914) and the third temperature value is not greater (e.g., less) than the second predetermined threshold value ("NO" branch of decision block 916), determine that the speaker element is located proximate to a second one of the right and left ears (920). As also shown, computing device 100 may, in the event the temperature difference value is not greater than the first predetermined threshold value ("NO" branch of decision block 914), determine whether the temperature difference value is less than the first predetermined threshold value (922). Computing device 100 may, in the event the temperature difference value is less than the first predetermined threshold value ("YES" branch of decision block 922), determine whether the third temperature value is greater than the second predetermined threshold value (924). Computing device 100 may, in the event the third temperature value is greater than the second predetermined threshold value ("YES" branch of decision block 924), determine that the speaker element is located proximate to the second one of the right and left ears (920). Alternatively, computing device 100 may, in the event the temperature difference value is less than the first predetermined threshold value ("YES" branch of decision block 922) and the third temperature value is not greater (e.g., less) than the second predetermined threshold value ("NO" branch of decision block 924), determine that the speaker element is located proximate to the first one of the right and left ears (918). Lastly, as further shown, computing device 100 may, in the event the temperature difference value is not less than the predetermined threshold value ("NO" branch of decision block 922), determine that the temperature difference value is equal to the predetermined threshold value (926), and determine that the speaker element is located proximate to neither ear (928).

In the examples of FIGS. 8 and 9, the first predetermined threshold value may correspond to the predetermined threshold value described above with reference to FIGS. 5 and 6. In other words, the first predetermined threshold value may be used to determine whether there is a (e.g., significant) difference between the first and second temperature values, in the manner previously described. As explained above with reference to FIG. 2, in these examples, the third temperature value received from the third temperature sensor may represent a user ambient temperature (e.g., a temperature surrounding the user, such as a temperature surrounding the user's right and left ears), or a user body temperature (e.g., a temperature of the user's body, such as a temperature of the user's tympanic membrane) associated with the user. As further explained above with reference to FIG. 2, also in these examples, the second predetermined threshold value may correspond to an expected, or estimated (e.g., a threshold) user body temperature, or an actual user body temperature measured using a fourth temperature sensor that is different than the first, second, and third temperature sensors described above. For example, the second predetermined threshold value may correspond to the user's actual body temperature (e.g., using the user's tympanic membrane temperature as a proxy), which may be measured by disposing the fourth temperature sensor within, on, or proximate to, various parts of the user's body, as described above. In other examples, the second predetermined threshold value may be a static or dynamic value stored in memory and representative of a typical, or expected, human body temperature of approximately 37° C./98° F., as also described above. Specifically, in examples where the first temperature sensor is located within a first portion of the speaker element and the second temperature sensor is located within a second, different portion of the speaker element, the third temperature value may represent a user ambient temperature associated with the user, and the second predetermined threshold value may correspond to an expected user body temperature, or an actual user body temperature measured using the fourth temperature sensor, associated with the user. Alternatively, in examples where the speaker element is a first speaker element, the headphone set further includes a second, different speaker element, the first temperature sensor is located within the first speaker element, and the second temperature sensor is located within the second speaker element, the third temperature value may represent a user body temperature associated with the user, and the second predetermined threshold value may correspond to a threshold user body temperature associated with the user.

Additionally, with reference to the determination of whether the third temperature value is greater than the second predetermined threshold value in each of decision blocks 916 and 924, in the event the third temperature value is equal to the second predetermined threshold value, e.g., indicating that the user ambient temperature is equal to the expected or measured user body temperature, or that the user body temperature is equal to the threshold user body temperature, as described above, computing device 100 may suspend or delay the automatic determination of speaker element location and/or relative orientation until a differential temperature is present. Alternatively, computing device 100 may proceed using the same approach as that taken when the user ambient temperature is greater or less than the expected or measured user body temperature, in some examples, or when the user body temperature is greater or less than the threshold user body temperature, as described herein.

In this manner, each of FIGS. 4-9 represents an example of a method of determining whether a speaker element of a headphone set is located proximate to a right ear, a left ear, or neither ear of a user of the headphone set, including receiving a first temperature value from a first temperature sensor, receiving a second temperature value from a second temperature sensor, and determining whether the speaker element is located proximate to the right ear, left ear, or neither ear, based on the first and second temperature values. In one or more of these examples, the first and second temperature sensors may be different temperature sensors, as described herein.

The techniques of the present disclosure may be implemented, at least in part, in hardware, software, firmware, or any combination thereof. For example, various aspects of the examples described herein may be implemented using one or more processors, including one or more microprocessors, microcontrollers, DSPs, ASICs, FPGAs, any other equivalent integrated or discrete logic devices or circuitry, or any combination of such components. In this disclosure, the term "processor" may generally refer to any of the logic devices or circuitry described above, alone or in combination with other logic devices or circuitry, or to any other equivalent logic devices or circuitry. Furthermore, such hardware, software, and firmware may be implemented within a common device, or within separate devices, to perform the techniques described herein. In addition, any of the above-described components, devices, and modules may be implemented together or separately as discrete but interoperable logic devices or circuitry. Illustrations of the various features of these techniques using components, devices, and modules are intended to draw attention to different functional aspects of the techniques. They do not necessarily imply that any such elements are implemented by separate hardware, software, or firmware components. Instead, the functionality associated with one or more of the components, devices, and modules may be implemented using separate or integrated hardware, software, or firmware components.

Additionally, the techniques described herein may be embodied in a tangible (e.g., non-transitory) computer-readable storage medium encoded with instructions. For example, the instructions may cause one or more processors (e.g., included as part of one or more computing devices) to implement one or more aspects of the techniques described herein by causing the processors to execute the instructions. In this context, the tangible computer-readable storage medium may include any of cache memory, RAM, ROM, PROM, EPROM, EEPROM, flash memory, SSD drives, any magnetic or optical computer-readable storage media, such as floppy disks, magnetic tape, HDDs, and CD-ROM or digital versatile disc (DVD) ROMs (DVD-ROMs), as well as any other computer-readable storage media. In some examples, the tangible computer-readable storage medium may include non-transitory storage media, which may indicate that the storage media are not embodied in a carrier wave or a propagated signal. Nevertheless, a non-transitory computer-readable storage medium consistent with these techniques may store data that can change over time, e.g., such as in the case of RAM or cache memory devices.

Various examples have been described in detail above. These, as well as numerous other examples, are within the scope of the following claims.

What is claimed is:

1. A method of determining whether a speaker element of a headphone set is located proximate to a right ear, a left ear, or neither ear of a user of the headphone set, the method comprising:

receiving a first temperature value from a first temperature sensor included in the headphone set;

receiving a second temperature value from a second temperature sensor included in the headphone set, wherein the first and second temperature sensors are different; and determining whether the speaker element is located proximate to the right ear, left ear, or neither ear, based on the first and second temperature values, wherein determining whether the speaker element is located proximate to the right ear, left ear, or neither ear, based on the first and second temperature values comprises:

calculating a temperature difference value based on the first and second temperature values;

comparing the temperature difference value to a predetermined threshold value; and determining whether the speaker element is located proximate to the right ear, left ear, or neither ear, based on a result of comparing the temperature difference value to the predetermined threshold value.

2. The method of claim 1, wherein the first temperature sensor is located within a first portion of the speaker element, wherein the second temperature sensor is located within a second portion of the speaker element, and wherein the first and second portions of the speaker element are different.

3. The method of claim 2, wherein the first and second temperature sensors located within the first and second portions, respectively, of the speaker element comprises the temperature sensors being disposed within a housing of the speaker element such that the temperature sensors are located at substantially opposite sides of a circular plane that is substantially centered about a portion of the speaker element that emits sound and is substantially orthogonal to a direction in which the speaker element emits sound.

4. The method of claim 2, wherein the first and second temperature sensors located within the first and second portions, respectively, of the speaker element comprises the temperature sensors being disposed within a housing of the speaker element such that, when the speaker element is located proximate to either one of the right and left ears, the temperature sensors are located at substantially opposite sides of an opening to an external auditory canal of the corresponding ear.

5. The method of claim 2, wherein the first and second temperature sensors located within the first and second portions, respectively, of the speaker element comprises the temperature sensors being disposed within a housing of the speaker element such that, when the speaker element is located proximate to the right ear, the first temperature sensor is relatively closer to a tragus portion of the right ear than the second temperature sensor, and when the speaker element is located proximate to the left ear, the second temperature sensor is relatively closer to a tragus portion of the left ear than the first temperature sensor.

6. The method of claim 1, wherein the speaker element comprises a first speaker element, wherein the headphone set further comprises a second speaker element, wherein the first and second speaker elements are different, wherein the first temperature sensor is located within the first speaker element, and wherein the second temperature sensor is located within the second speaker element.

7. The method of claim 1, wherein determining whether the speaker element is located proximate to the right ear, left ear, or neither ear, based on the result of comparing the temperature difference value to the predetermined threshold value comprises one or more of the following:

in the event the temperature difference value is greater than the predetermined threshold value, determining that the speaker element is located proximate to a first one of the right and left ears;

in the event the temperature difference value is less than the predetermined threshold value, determining that the speaker element is located proximate to a second one of the right and left ears; and in the event the temperature difference value is equal to the predetermined threshold value, determining that the speaker element is located proximate to neither ear.

8. The method of claim 7, wherein the predetermined threshold value comprises a range of values, wherein the temperature difference value being one of greater than and less than the predetermined threshold value comprises the temperature difference value corresponding to a value that is outside of the range of values, and wherein the temperature difference value being equal to the predetermined threshold value comprises the temperature difference value corresponding to a value that is within the range of values.

9. The method of claim 1, further comprising:

receiving a third temperature value from a third temperature sensor, wherein the first, second, and third temperature sensors are different; and determining whether the speaker element is located proximate to the right ear, left ear, or neither ear, based on the third temperature value.

10. The method of claim 9, wherein the third temperature value received from the third temperature sensor indicates one of an ambient temperature and a body temperature associated with the user of the headphone set.

11. The method of claim 9, wherein the predetermined threshold value comprises a first predetermined threshold value, and wherein determining whether the speaker element is located proximate to the right ear, left ear, or neither ear, based on the third temperature value comprises:

comparing the third temperature value to a second predetermined threshold value; and determining whether the speaker element is located proximate to the right ear, left ear, or neither ear, based on a result of comparing the third temperature value to the second predetermined threshold value.

12. The method of claim 11, wherein determining whether the speaker element is located proximate to the right ear, left ear, or neither ear, based on the result of comparing the temperature difference value to the first predetermined threshold value and based on the result of comparing the third temperature value to the second predetermined threshold value comprises one or more of the following:

in the event the temperature difference value is greater than the first predetermined threshold value and the third temperature value is greater than the second predetermined threshold value, determining that the speaker element is located proximate to a first one of the right and left ears;

in the event the temperature difference value is greater than the first predetermined threshold value and the third temperature value is less than the second predetermined threshold value, determining that the speaker element is located proximate to a second one of the right and left ears;

in the event the temperature difference value is less than the first predetermined threshold value and the third temperature value is greater than the second predetermined threshold value, determining that the speaker element is located proximate to the second one of the right and left ears;

in the event the temperature difference value is less than the first predetermined threshold value and the third temperature value is less than the second predetermined threshold value, determining that the speaker element is located proximate to the first one of the right and left ears; and in the event the temperature difference value is equal to the first predetermined threshold value, determining that the speaker element is located proximate to neither ear.

13. An apparatus for determining whether a speaker element of a headphone set is located proximate to a right ear, a left ear, or neither ear of a user of the headphone set comprising one or more computing devices configured to:

receive a first temperature value from a first temperature sensor included in the headphone set;

receive a second temperature value from a second temperature sensor included in the headphone set, wherein the first and second temperature sensors are different; and determine whether the speaker element is located proximate to the right ear, left ear, or neither ear, based on the first and second temperature values, wherein to determine whether the speaker element is located proximate to the right ear, left ear, or neither ear, based on the first and second temperature values, the one or more computing devices are configured to:

calculate a temperature difference value based on the first and second temperature values;

compare the temperature difference value to a predetermined threshold value; and determine whether the speaker element is located proximate to the right ear, left ear, or neither ear, based on a result of comparing the temperature difference value to the predetermined threshold value.

14. The apparatus of claim 13, wherein the first temperature sensor is located within a first portion of the speaker element, wherein the second temperature sensor is located within a second portion of the speaker element, and wherein the first and second portions of the speaker element are different.

15. The apparatus of claim 14, wherein the first and second temperature sensors located within the first and second portions, respectively, of the speaker element comprises one or more of the following:

the temperature sensors being disposed within a housing of the speaker element such that the temperature sensors are located at substantially opposite sides of a circular plane that is substantially centered about a portion of the speaker element that emits sound and is substantially orthogonal to a direction in which the speaker element emits sound;

the temperature sensors being disposed within the housing such that, when the speaker element is located proximate to either one of the right and left ears, the temperature sensors are located at substantially opposite sides of an opening to an external auditory canal of the corresponding ear; and the temperature sensors being disposed within the housing such that, when the speaker element is located proximate to the right ear, the first temperature sensor is relatively closer to a tragus portion of the right ear than the second temperature sensor, and when the speaker element is located proximate to the left ear, the second temperature sensor is relatively closer to a tragus portion of the left ear than the first temperature sensor.

16. The apparatus of claim 13, wherein the speaker element comprises a first speaker element, wherein the headphone set further comprises a second speaker element, wherein the first and second speaker elements are different, wherein the first temperature sensor is located within the first speaker element, and wherein the second temperature sensor is located within the second speaker element.

17. The apparatus of claim 13, wherein the one or more computing devices are further configured to:

receive a third temperature value from a third temperature sensor, wherein the first, second, and third temperature sensors are different; and determine whether the speaker element is located proximate to the right ear, left ear, or neither ear, based on the third temperature value.

18. The apparatus of claim 17, wherein the third temperature value received from the third temperature sensor indicates one of an ambient temperature and a body temperature associated with the user of the headphone set.

19. A non-transitory computer-readable storage medium comprising instructions that cause one or more computing devices to determine whether a speaker element of a headphone set is located proximate to a right ear, a left ear, or neither ear of a user of the headphone set, the instructions causing the one or more computing devices to:

receive a first temperature value from a first temperature sensor included in the headphone set;

receive a second temperature value from a second temperature sensor included in the headphone set, wherein the first and second temperature sensors are different; and determine whether the speaker element is located proximate to the right ear, left ear, or neither ear, based on the first and second temperature values, wherein the instructions that cause the one or more computing devices to determine whether the speaker element is located proximate to the right ear, left ear, or neither ear, based on the first and second temperature values comprise instructions that cause the one or more computing devices to:

calculate a temperature difference value based on the first and second temperature values:

compare the temperature difference value to a predetermined threshold value; and determine whether the speaker element is located proximate to the right ear, left ear, or neither ear, based on a result of comparing the temperature difference value to the predetermined threshold value.

* * * * *